US008794197B2

(12) United States Patent
Sato et al.

(10) Patent No.: US 8,794,197 B2
(45) Date of Patent: Aug. 5, 2014

(54) COOLING-MEANS-EQUIPPED, LIQUID-COOLED ENGINE

(75) Inventors: Yoshikazu Sato, Wako (JP); Keita Ito, Wako (JP); Yasuhiro Shimizu, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 463 days.

(21) Appl. No.: 13/226,075

(22) Filed: Sep. 6, 2011

(65) Prior Publication Data

US 2012/0067307 A1 Mar. 22, 2012

(30) Foreign Application Priority Data

Sep. 16, 2010 (JP) ..... 2010-208548

(51) Int. Cl.

| | |
|---|---|
| ***F02F 1/14*** | (2006.01) |
| ***F01P 3/14*** | (2006.01) |
| ***F02F 1/40*** | (2006.01) |
| ***F01L 1/18*** | (2006.01) |
| ***F02B 75/16*** | (2006.01) |
| ***F01P 3/18*** | (2006.01) |
| ***F02F 1/00*** | (2006.01) |
| *F01L 1/053* | (2006.01) |
| *F01L 1/20* | (2006.01) |
| *F01L 3/00* | (2006.01) |

(52) U.S. Cl.

CPC ..... *F02F 1/002* (2013.01); *F01L 2250/04* (2013.01); *F01L 2001/0535* (2013.01); *F01P 3/14* (2013.01); *F01L 1/20* (2013.01); *F02F 1/40* (2013.01); *F01L 2003/256* (2013.01); *F01L 1/181* (2013.01); *F02B 75/16* (2013.01); *F01P 3/18* (2013.01); *F01L 1/053* (2013.01)

USPC ..... 123/41.79; 123/41.44; 123/41.01; 123/41.15

(58) Field of Classification Search

USPC ..... 123/41.79, 41.01, 41.44, 41.15

See application file for complete search history.

(56) References Cited

U.S. PATENT DOCUMENTS 4,700,665 A * 10/1987 Kanda et al. ..... 123/41.82 R
4,858,573 A * 8/1989 Bothwell ..... 123/90.15

(Continued)

FOREIGN PATENT DOCUMENTS

EP 1445430 A1 * 8/2004
JP 53-3345 U 1/1978

(Continued)

OTHER PUBLICATIONS

Japanese Office Action dated Aug. 27, 2013, issued in corresponding Japanese Patent Application No. 2010-208548, w/ English translation.

*Primary Examiner* — Marguerite McMahon
*Assistant Examiner* — James Kim
(74) *Attorney, Agent, or Firm* — Westerman, Hattori, Daniels & Adrian, LLP

(57) ABSTRACT

A liquid-cooled engine provided with cooling means for cooling an area surrounding a combustion chamber using a cooling liquid cooled by a radiator and caused to flow through a cooling passage. The cooling passage is embedded inside a cylinder block and a cylinder head. The cooling passage is formed in a continuous fashion such that the cooling liquid is introduced from the radiator to cool an area surrounding the combustion chamber, and thereafter returns to the radiator by looping around an area surrounding an exhaust valve for opening and closing an exhaust port of the combustion chamber.

3 Claims, 15 Drawing Sheets

(56) References Cited

U.S. PATENT DOCUMENTS

| | | | | |
|---|---|---|---|---|
| 5,785,028 | A * | 7/1998 | Anderson et al. | 123/193.3 |
| 5,873,330 | A * | 2/1999 | Takahashi et al. | 123/41.31 |
| 6,588,381 | B2 * | 7/2003 | Komorowski | 123/41.44 |
| 6,810,838 | B1 * | 11/2004 | Hellman | 123/41.28 |
| 8,151,743 | B2 * | 4/2012 | Reustle | 123/41.82 R |
| 2005/0056396 | A1 * | 3/2005 | Shinohara et al. | 165/41 |
| 2007/0235007 | A1 * | 10/2007 | Yasui et al. | 123/406.23 |
| 2013/0186061 | A1 * | 7/2013 | Jarzombek et al. | 60/273 |

FOREIGN PATENT DOCUMENTS

| | | | | |
|---|---|---|---|---|
| JP | 53-139412 | U | | 11/1978 |
| JP | 55-139943 | A | | 11/1980 |
| JP | 58-40654 | B2 | | 9/1983 |
| JP | 62-159750 | A | | 7/1987 |
| JP | 3-258917 | A | | 11/1991 |
| JP | 2008-286009 | A | | 11/2008 |
| JP | 2008286009 | A | * | 11/2008 |

* cited by examiner

COOLING-MEANS-EQUIPPED, LIQUID-COOLED ENGINE

FIELD OF THE INVENTION

The present invention relates to a liquid-cooled engine equipped with cooling means in which a cooling liquid cooled by a radiator is caused to flow through a cooling passage in order to cool the surrounding area of a combustion chamber.

BACKGROUND OF THE INVENTION

Liquid-cooled engines equipped with cooling means are used, for example, as drive sources in electrical generators, operating machinery, and the like. One known example is the cooling-means equipped engine disclosed, for example, in Japanese Patent Application Laid-Open Publication No. S62-159750 (S62-159750 A), which has an integrally formed cylinder block and cylinder head and a water jacket formed on the cylinder block, and is equipped with cooling means having a cooling passage embedded inside the cylinder head. In this engine, causing a cooling liquid to flow through the water jacket of the cylinder block and through the cooling passage of the cylinder head makes it possible to cool the cylinder block and the cylinder head.

In the past, configuring a water jacket involved dividing the cylinder and the cylinder head to form a conduit. However, this means that the cylinder and the cylinder head are two separate members and that space is needed for fastening bolts, therefore creating problems of difficulty in reducing size and weight, and of an increased number of parts.

Further, in a case where the cylinder and the cylinder head are integrally formed, the conduit is formed in the core, and because a low-pressure die casting fabrication process is employed, problems of lengthy production time and increased production costs are encountered.

A potential countermeasure entails forming a cooling passage to the outside of the cylinder block in place of the water jacket, thereby ensuring ample cooling capacity.

However, in cases where a cooling passage is formed to the outside of the cylinder block, it becomes difficult to maintain compactness of a compact engine. It has accordingly been considered difficult to ensure ample cooling capacity in a state in which compactness of a compact engine is maintained.

SUMMARY OF THE INVENTION

It is an object of the present invention to provide a liquid-cooled engine equipped with cooling means, whereby ample cooling capacity can be ensured, while maintaining compactness.

According to an aspect of the present invention, there is provided a cooling-means-equipped, liquid-cooled engine which comprises: a radiator; and a cooling passage through which a cooling liquid cooled in the radiator flows to thereby cool an area surrounding a combustion chamber of an engine body, wherein the cooling passage is embedded inside a cylinder block and a cylinder head that constitutes the engine body, and is formed in a continuous fashion such that the cooling liquid is introduced from the radiator to cool the area surrounding the combustion chamber, and thereafter returns to the radiator by looping around an area surrounding an exhaust valve for opening and closing an exhaust port of the combustion chamber.

The cooling passage is formed in a continuous fashion in an embedded (inset) state inside the cylinder block and cylinder head. By embedding the cooling passage in the cylinder block and cylinder head, compactness can thus be maintained in the liquid-cooled engine equipped with cooling means. The phrase, "the cooling passage . . . in an embedded state" is used in a sense that includes a state in which the entire cooling passage is embedded, and a state in which a portion of the cooling passage is embedded.

By causing a cooling liquid to flow through the cooling passage, the cooling liquid flows through the area surrounding the combustion chamber, and the cooling liquid having cooled the area surrounding the combustion chamber flows in a loop around the area surrounding the exhaust valve. Therefore, the area surrounding the combustion chamber can be cooled by the cooling liquid, and the area surrounding the exhaust valve can be cooled by the cooling liquid.

In an engine, the area surrounding the combustion chamber and the area surrounding the exhaust valve are ordinarily at higher temperatures than other regions. Ample cooling capacity can thereby be ensured by cooling the area surrounding the combustion chamber and the area surrounding the exhaust valve by the cooling liquid. Therefore, according to the present invention, ample cooling capacity can be ensured in a state where compactness of the liquid-cooled engine equipped with cooling means is maintained.

Preferably, the cylinder block and the cylinder head are integrally formed. By integrally forming the cylinder block and the cylinder head, it is thus possible to maintain compactness of the liquid-cooled engine equipped with cooling means. When the cylinder block and the cylinder head are integrally formed, a cooling passage can be embedded therein in a continuously formed state. Therefore, the cooling passage can be readily embedded inside the integrally formed cylinder block and cylinder head.

Desirably, the engine further comprises: a cam for driving an intake valve and the exhaust valve for opening and closing the combustion chamber; and a hollow cam shaft for supporting the cam and serving as a portion of the cooling passage. Thus, the need for a dedicated cam shaft, which according the prior art is necessary to support the cam, can be obviated. In so doing, the number of parts can be reduced, the need for space to furnish the dedicated cam shaft can be obviated, and the liquid-cooled engine equipped with cooling means can be made even more compact.

In a preferred form, the cam shaft is furnished on the same axis as a pump for circulating the cooling liquid. Therefore, the need for a dedicated pump shaft which is necessary to support the pump according the prior art can be obviated. In so doing, the number of parts can be reduced, the need for space to furnish a dedicated pump shaft can be obviated, and the liquid-cooled engine equipped with cooling means can be made even more compact.

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENT

Figure 1:
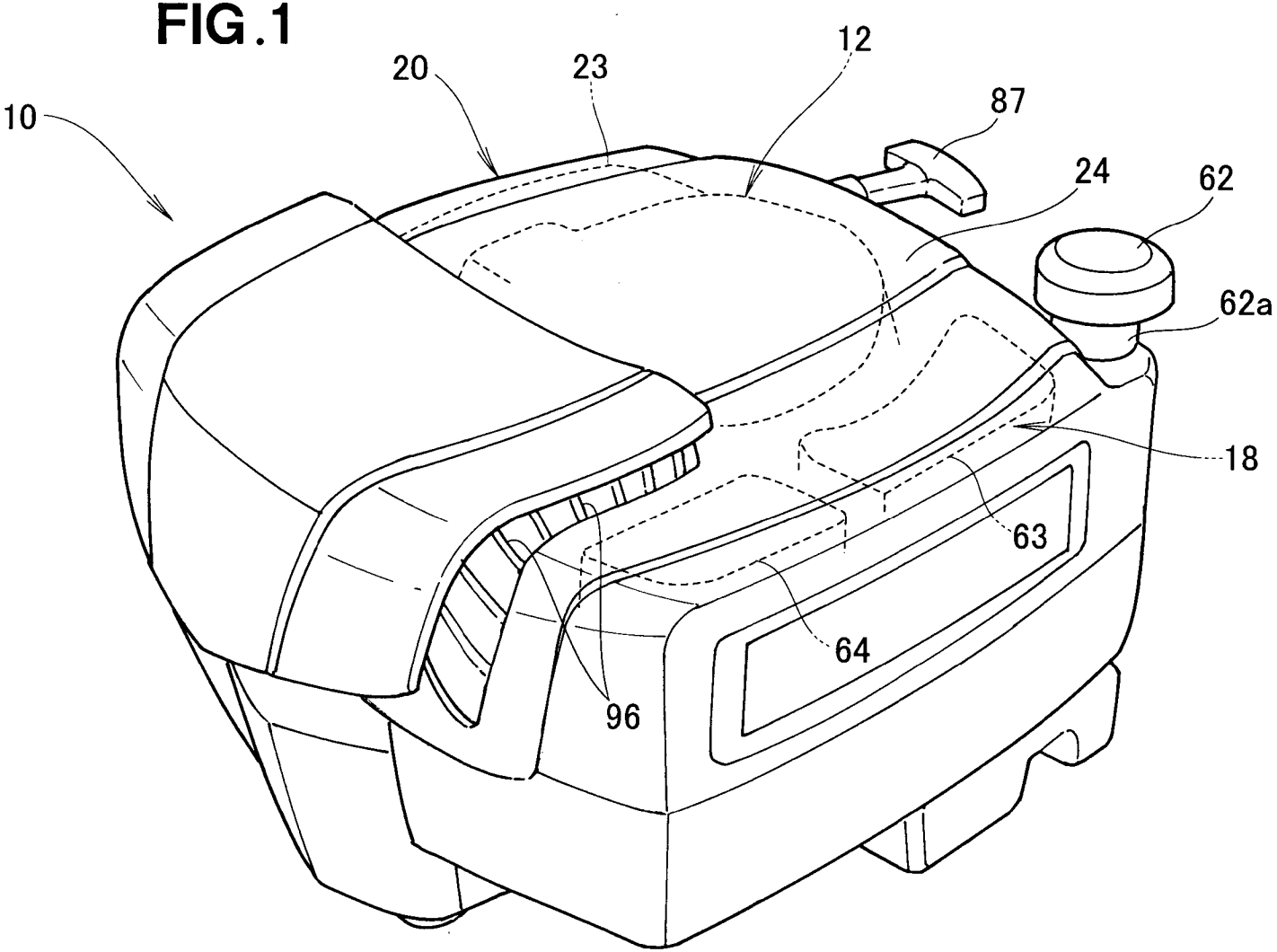
FIG. 1 is a perspective view illustrating a liquid-cooled engine equipped with cooling means according to an embodiment of the present invention.
Figure 2:
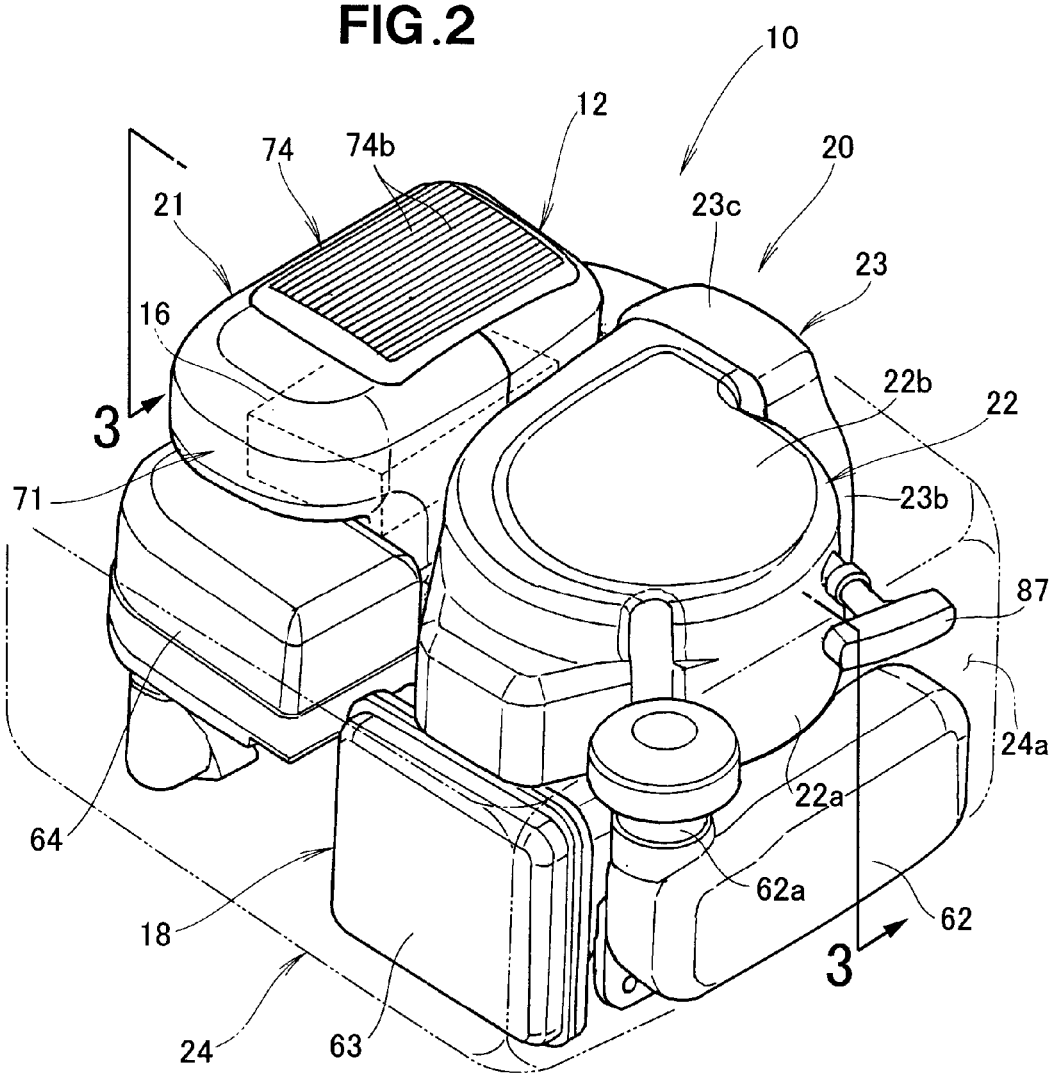
FIG. 2 is a perspective view illustrating the cooling-means-equipped, liquid-cooled engine of FIG. 1, with an outer cover removed.

As depicted in FIGS. 1 and 2, a liquid-cooled engine 10 equipped with cooling means is a general-purpose engine of liquid-cooled design provided with an entire engine 12 that includes an engine body 14 (see FIG. 3) and a radiator 16; and a cover structure 20 covering the entire engine 12. A general-purpose engine of water-cooled design may be cited as an example of a general-purpose engine of liquid-cooled design.

Figure 3:
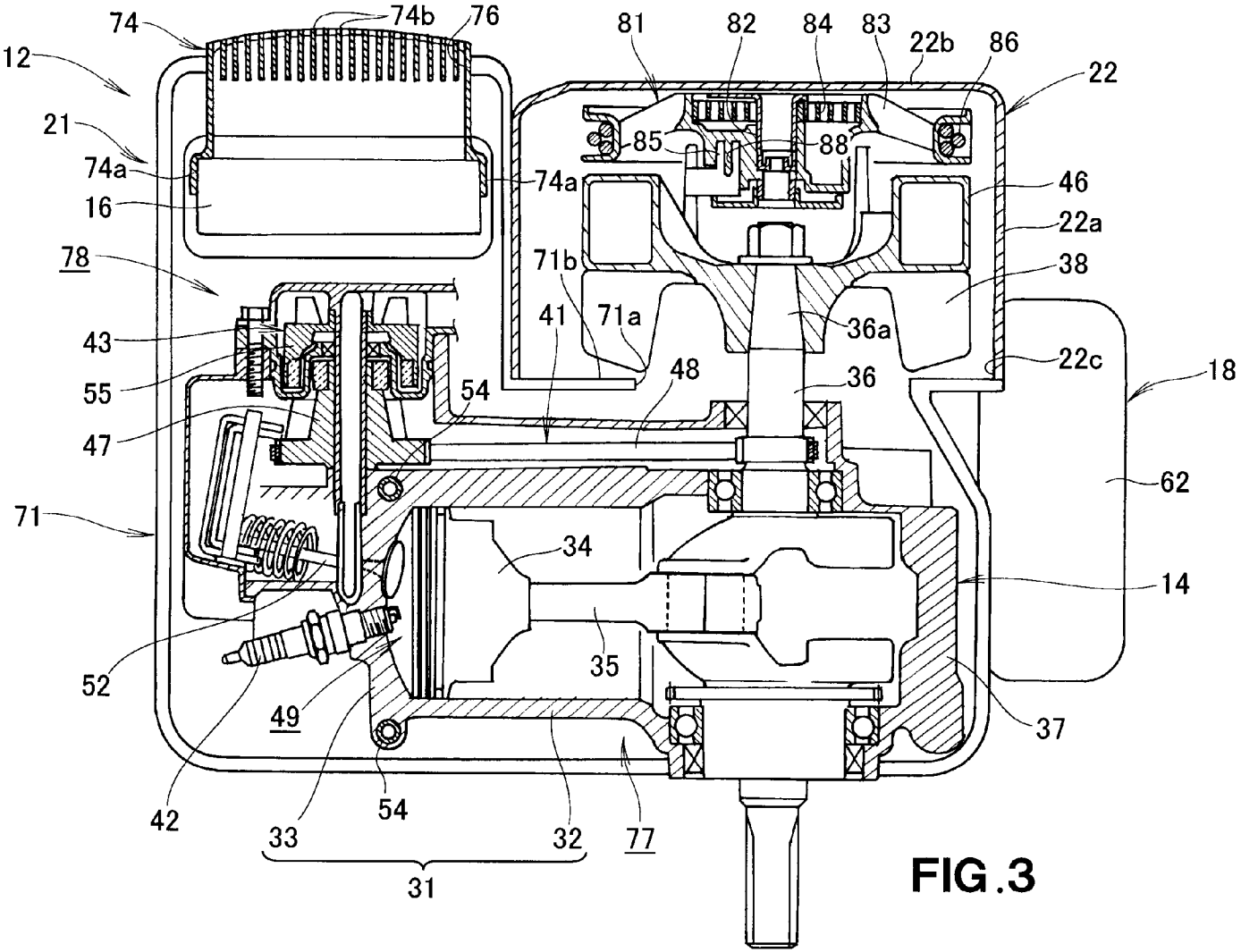
FIG. 3 is a sectional view taken along line 3-3 of FIG. 2.

As depicted in FIG. 3, the entire engine 12 is provided with the engine body 14 in which a piston 34 is furnished inside a cylinder block 32 of a cylinder block/head 31; with the radiator 16 which cools the engine body 14; and with peripheral equipment 18 furnished at the periphery of the engine body 14.

In the cylinder block/head 31 of the engine body 14, the cylinder block 32 and cylinder head 33 are molded as an integrated entity. The material used for the cylinder block/head 31 is, for example, an aluminum material for die casting (ADC 12).

In the engine body 14, the piston 34 is furnished inside the cylinder block 32; a crankshaft 36 is linked to the piston 34 via a connecting rod 35, and the crankshaft 36 is covered by a crankcase 37.

Further, in the engine body 14, a cooling fan 38 is furnished to an end section 36*a* of the crankshaft 36 which protrudes from the crankcase 37, a valve train 41 is furnished to the cylinder head 33 and the cylinder block/head 31, and a spark plug 42 and cooling means 43 are furnished to the cylinder head 33.

The cooling fan 38 is furnished on the same axis as a flywheel 46. By virtue of being furnished on the same axis as the end section 36*a* of the crankshaft 36, the flywheel 46 is disposed above the crankcase 37. Therefore, the cooling fan 38 is furnished on the same axis as the end section 36*a* of the crankshaft 36, and is disposed above the crankcase 37. Through rotation of the cooling fan 38, cooling air introduced from an external origin can be introduced into the radiator 16, and cooling air for cooling the radiator 16 can be introduced into the muffler. The flywheel 46 is a member for ensuring smooth rotation of the crankshaft 36.

The valve train 41 is provided with transmission means 48 for transmitting rotation of the crankshaft 36 to a cam member (cam) 47; an intake valve 51 (see FIG. 4) and an exhaust valve 52 for opening and closing a combustion chamber 49 through rotation of the cam member 47; and other related members of the valve train 41.

Owing to the valve train 41, the rotation of the crankshaft 36 is transmitted by the transmission means 48 to the cam member 47 whereby the cam member 47 rotates. The intake valve 51 and the exhaust valve 52 are operated through rotation of the cam member 47. The valve train 41 is described in detail in FIGS. 4 to 7.

The cooling means 43 is provided with a cooling passage 54 which is embedded (inset) in the area surrounding the cylinder head 33 and which communicates with the radiator 16; and a water pump (pump) 55 and a thermostat 56 (see FIG. 8) which are furnished midway along the cooling passage 54. The water pump 55 is furnished above the cylinder head 33 and is linked to the transmission means 48. Therefore, the rotation of the crankshaft 36 is transmitted to the water pump 55 via the transmission means 48, and the water pump 55 rotates. The cooling means 43 is described in FIGS. 8 to 11.

The radiator 16 has the same configuration as radiators commonly used for cooling engines. The radiator 16 is furnished above the water pump 55, and is furnished adjacent to the cooling fan 38. Therefore, the rotation of the cooling fan 38 enables the intake power of the cooling fan 38 to be imparted to the radiator 16 so that cooling air passes through the radiator 16.

The cooling passage 54 of the cooling means 43 (a portion of the cooling passage is not visible in the drawings) communicates with the aforedescribed radiator 16. Therefore, the cooling liquid which has cooled the engine body 14 can be circulated to the radiator 16 through the cooling passage 54. Circulating the cooling liquid which has cooled the engine body 14 to the radiator 16 enables the cooling liquid to be cooled by the radiator 16. Specifically, owing to the cooling means 43 and the radiator 16, the engine body 14 can be cooled by the cooling liquid, through circulation of the cooling liquid inside the cooling passage 54 by the water pump 55.

Here, in a case where the cooling liquid has not risen to a prescribed temperature, through operation of the thermostat 56, cooling liquid having cooled the engine body 14 can be circulated to the engine body 14 through the water pump 55. On the other hand, in a case where the cooling liquid has risen to the prescribed temperature, through operation of the thermostat 56, cooling liquid having cooled the engine body 14 is introduced to the radiator 16 through the water pump 55. The introduced cooling liquid is cooled by the radiator 16, and the cooled cooling liquid is circulated to the engine body 14 to cool the engine body 14.

As depicted in FIGS. 1 and 2, the peripheral equipment 18 includes a muffler, a fuel tank 62, an oil tank 63, and an air cleaner 64 which are furnished at the periphery of the engine body 14. The peripheral equipment 18 is covered by the cover structure 20.

As depicted in FIGS. 2 and 3, the cover structure 20 is provided with an engine cover 21 that covers the engine body 14 (see FIG. 3) and the radiator 16; a recoil cover 22 that covers the cooling fan 38 of the engine body 14; a muffler cover 23 that covers the muffler of the peripheral equipment 18; and an outer cover 24 that covers the entire engine 12.

The engine cover 21 is comprised of a cover main unit 71 that covers the engine body 14 and the radiator 16; and a radiator guard 74 furnished to the cover main unit 71.

The cover main unit 71 is formed to an approximately L shape in side view, and has a cooling air introduction port 76 for introducing cooling air to the inside. The radiator 16 is supported on this cooling air introduction port 76 via a support region 74*a* of the radiator guard 74. By supporting the radiator 16 on the cooling air introduction port 76, cooling air drawn in from the cooling air introduction port 76 can be conducted into the radiator 16.

In the radiator guard 74, guard louvers 74*b* are formed in a region which fits together with the cooling air introduction port 76. The guard louvers 74*b* have a plurality of single louvers furnished at a predetermined spacing. Therefore, cooling air can be introduced from the outside of the engine cover 21 through the guard louvers 74 (specifically, the cooling air introduction port 76), and into an upper housing space 78 of the cover main unit 71. Further, by forming the guard louvers 74 on the radiator guard 74, the radiator 16 can be protected by the radiator guard 74.

The cooling fan 38 is disposed adjacently above a ceiling section 71*b* of the cover main unit 71. A cover opening 71*a* is formed in the ceiling section 71*b*. By forming the cover opening 71*a*, the cooling fan 38 communicates with a housing space 77 of the cover main unit 71 via the cover opening 71*a*.

The cooling fan 38 is covered by the recoil cover 22. The recoil cover 22 has a peripheral side wall 22*a* formed along the outside periphery of the cooling fan 38, an apical section 22*b* obstructing the upper end section of the peripheral side wall 22*a*, and a lower section opening 22*c* in the lower end section of the peripheral side wall 22*a*.

The lower section opening 22*c* of the recoil cover 22 faces (opposes) the cover opening 71*a*. Therefore, the lower section opening 22*c* of the recoil cover 22 communicates with the cooling air introduction port 76 through the cover opening 71*a*, the housing space 77, and the upper housing space 78.

The radiator 16 is furnished in the cooling air introduction port 76. Further, the radiator 16 is disposed adjacent to the cooling fan 38. Therefore, through rotation of the cooling fan 38, cooling air can be introduced favorably into the cooling air introduction port 76 (specifically, the radiator 16). In so doing, the cooling liquid inside the radiator 16 can be appropriately cooled by the cooling air, and the general-purpose liquid-cooled engine 10 can be efficiently cooled by the cooled cooling liquid.

A recoil starter 81 for engine startup is accommodated inside the recoil cover 22. The recoil starter 81 is provided with a support shaft 82 furnished to the apical section 22*b* of the recoil cover 22; a pulley 83 rotatably supported on the support shaft 82; a recoil spring 84 linked to the pulley 83 and to the support shaft 82; a one-way clutch 85 furnished to the pulley 83; a cable 86 linked at the basal end section to the pulley 83 and wound about the outside periphery thereof; and a recoil knob 87 (FIG. 1) furnished to the distal end of the cable 86.

The support shaft 82 extends toward the crankshaft 36, and is disposed on the same axis with respect to the crankshaft 36. In the one-way clutch 85, an engaging pawl (not shown) engages an engaging groove 88 of the flywheel 46. Therefore, manually gripping and pulling the recoil knob 87 (FIG. 1) causes the pulley 83 to rotate in opposition to the spring force of the recoil spring 84. Rotation of the pulley 83 causes the crankshaft 36 to rotate via the flywheel 46. The general-purpose liquid-cooled engine 10 is started by the rotation of the crankshaft 36. Starting the general-purpose liquid-cooled engine 10 causes the engaging pawl to disengage from the engaging groove 88 of the flywheel 46. Releasing the hand from the recoil knob 87 causes the pulley 83 to rotate due to the spring force of the recoil spring 84, winding the cable 86 about the pulley 83.

As depicted in FIGS. 1 and 2, the outer cover 24 is formed with a substantially rectangular shape so as to cover the entire engine 12. In this outer cover 24 are formed outer louvers 96 in a region corresponding to the radiator guard 74. The outer louvers 96 are a plurality of single louvers furnished at a predetermined spacing.

By forming the outer louvers 96 in a region corresponding to the radiator guard 74, outside air can be introduced as cooling air into the interior of the outer cover 24 from outside the outer cover 24.

As depicted in FIG. 3, the cooling air introduced into the interior the outer cover 24 can be introduced into the upper housing space 78 of the engine cover 21 through the guard louvers 74*b* of the radiator guard 74 (the cooling air introduction port 76). Introducing the cooling air into the upper housing space 78 allows the introduced cooling air to pass through the radiator 16. The cooling liquid inside the radiator 16 can be cooled through introduction of the cooling air into the radiator 16.

Next, the valve train 41 is described on the basis of FIGS. 4 to 7. In FIGS. 4 to 7, in order to facilitate understanding of the configuration of the valve train 41, the engine body 14 is depicted in an upright state.

Figure 4:
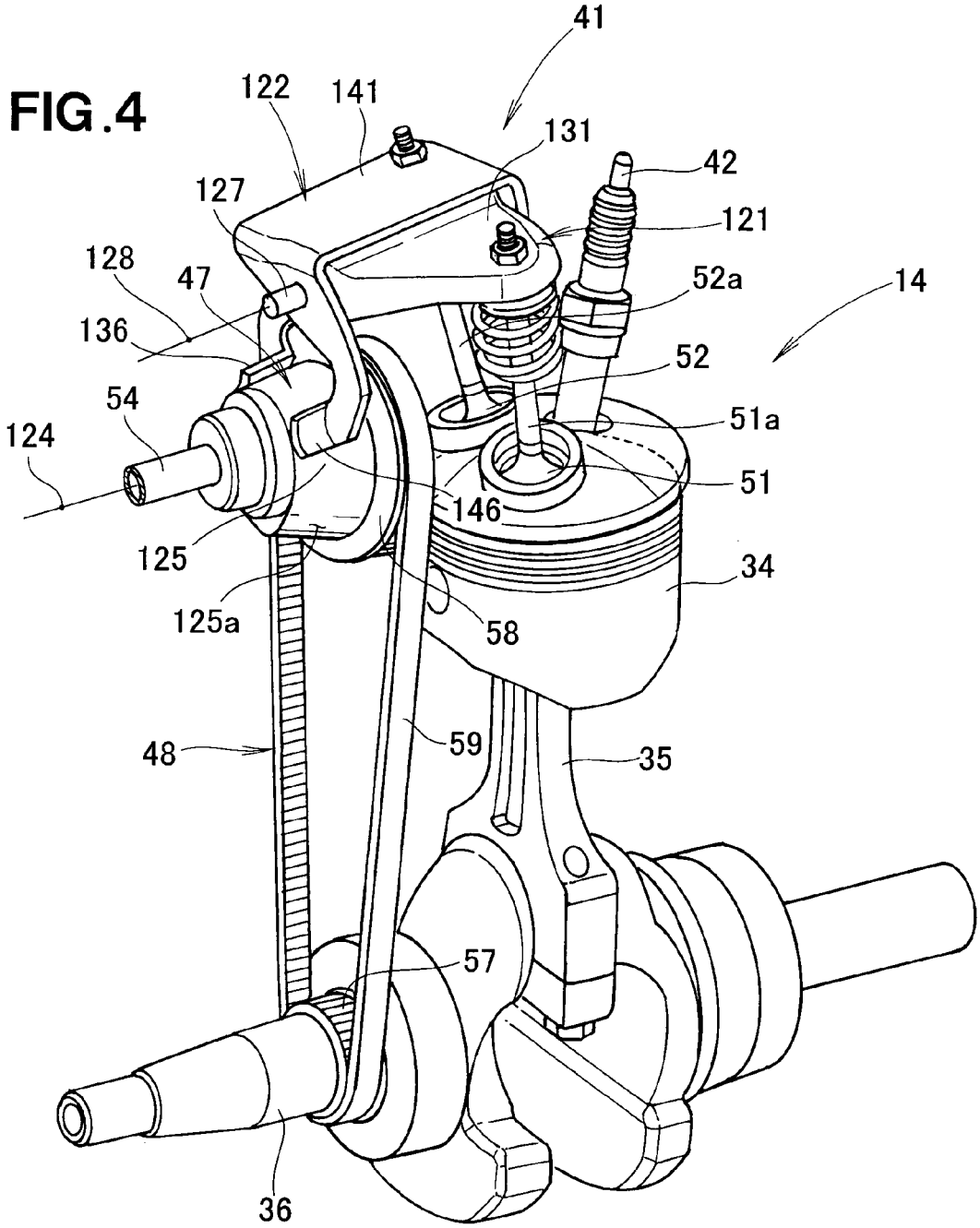
FIG. 4 is a perspective view showing a valve train of FIG. 3.

As depicted in FIG. 4, the valve train 41 is provided with the transmission means 48 for transmitting the rotation (power) of the crankshaft 36 to the cam member 47; the cam member 47 which is integrally formed with a driven pulley 58 of the transmission means 48; an intake rocker arm 121 and an exhaust rocker arm 122 operated by rotation of the cam member 47; the intake valve 51 which is linked to the intake rocker arm 121; and the exhaust valve 52 which is linked to the exhaust rocker arm 122.

The transmission means 48 is provided with a driving pulley 57 furnished to the crankshaft 36; the driven pulley 58 which is rotatably supported by the cooling passage 54; and an endless transmission belt (timing belt) 59 wound around the driving pulley 57 and the driven pulley 58.

Through rotation of the crankshaft 36, rotation of the driving pulley 57 is transmitted to the driven pulley 58 via the transmission belt 59. The driven pulley 58 is furnished on the same axis with respect to a centerline (a centerline of rotation of the cam member 47) 124 of the cooling passage 54. The rotation of the driving pulley 57 is transmitted to the driven pulley 58, whereby the driven pulley 58 is driven.

Figure 5:
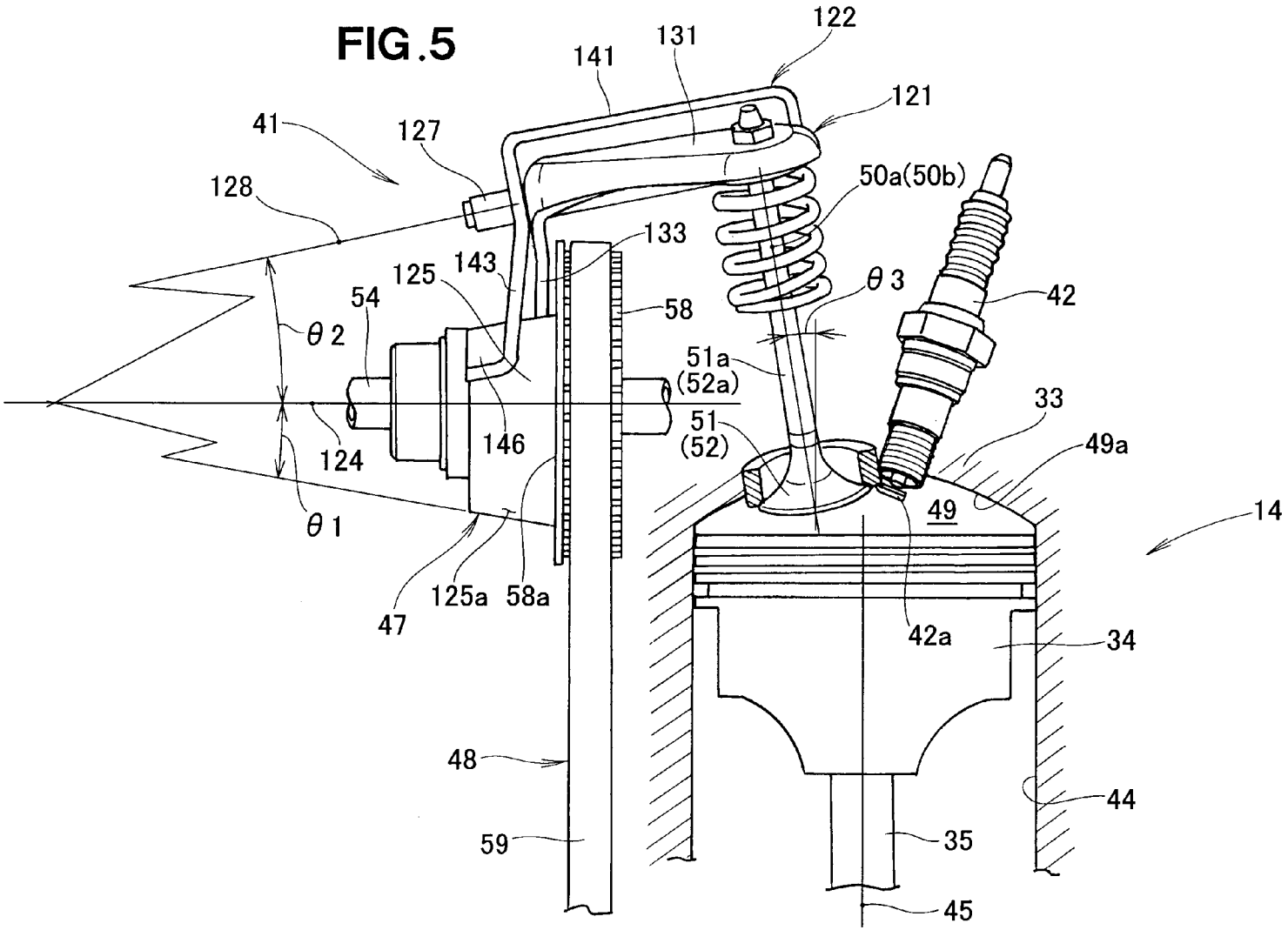
FIG. 5 is a side view of the valve train shown in FIG. 4.

As depicted in FIG. 5, the cam member 47 is integrally formed with a face (specifically, the outer face) 58*a* on the driven pulley 58, the face being on the side opposite the cylinder head 33. In this state, the cam member 47 is furnished on the same axis with respect to the driven pulley 58, and is rotatably supported by the cooling passage 54. Therefore, the driven pulley 58 which is driven by the transmission belt 59 is provided to the combustion chamber 49 side with respect to the cam member 47. Therefore, the driven pulley 58 and the transmission belt 59 can be situated in proximity to the combustion chamber 49 and cylinder 44 side. By situating the driven pulley 58 and the transmission belt 59 in proximity to the combustion chamber 49 and cylinder 44 side in this way, the valve train system can be made more compact.

By disposing the driven pulley 58 on the combustion chamber 49 side, the cam member 47 can be disposed away from the combustion chamber 49. Situating the cam member 47 away from the combustion chamber 49 makes the cam member less susceptible to being affected by heat emitted by the combustion chamber 49, and able of being molded from a resin material. Therefore, by molding the cam member 47 from a resin material and forming the driven pulley 58 from a sintered material, it is possible for the cam member 47 and the driven pulley 58 to be integrally formed. In so doing, the number of parts can be reduced, and the valve train system can be made even more compact.

The cam member 47 has a cam face 125 inclined at an incline angle θ1 with respect to the centerline (the centerline of rotation of the cam member 47) 124 of the cooling passage 54. Specifically, the cam face 125 is formed in an inclined shape so that the diameter decreases progressively further away from the combustion chamber 49. As with an ordinary cam face, a projecting section 125*a* is formed in one portion on the periphery of the cam face 125.

Figure 6:
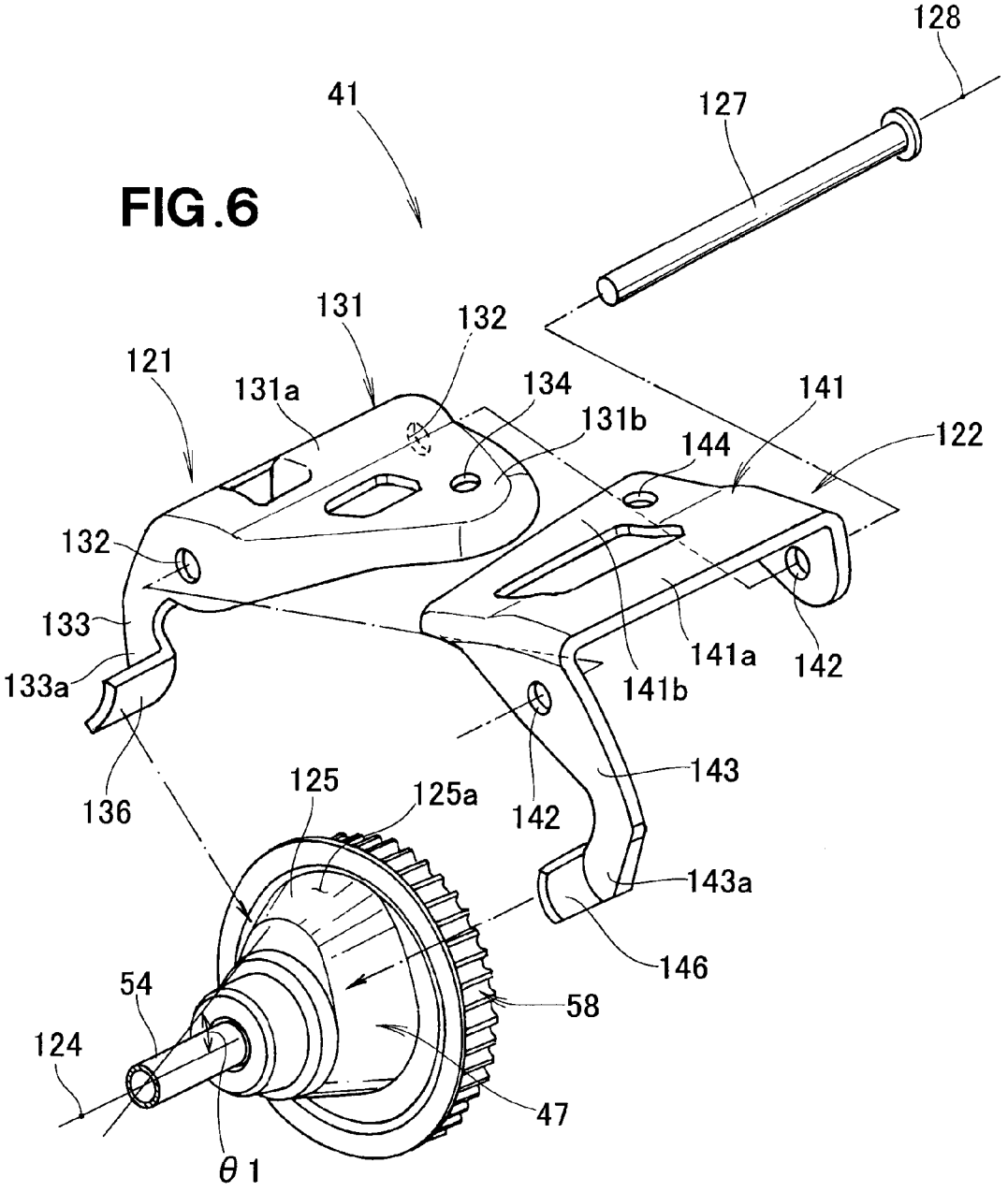
FIG. 6 is an exploded perspective view showing the valve train of FIG. 4.

As depicted in FIGS. 4 and 6, operation (rotation) of the cam member 47 causes the intake rocker arm 121 and the exhaust rocker arm 122 to swing about a swing shaft 127.

The intake rocker arm 121 has an intake arm main unit 131 swingably supported on the swing shaft 127, and an intake slipper (slipper) 136 furnished to the intake arm main unit 131. The intake arm main unit 131 is furnished in a basal section 131*a* thereof with a pair of through-holes 132; has an extending section 133 extending from the basal section 131*a*; and has a mounting hole 134 formed in a distal end section 131*b* thereof. The swing shaft 127 is pivotably inserted through the pair of through-holes 132, whereby the intake arm main unit 131 is swingably supported on the swing shaft 127.

A valve rod 51*a* of the intake valve 51 is mounted in the mounting hole 134 using a nut. The intake slipper 136 is provided to a distal end 133*a* of the extending section 133. The intake slipper 136 is disposed parallel to the cam face 125 so as to slide against the cam face 125.

The exhaust rocker arm 122 has an exhaust arm main unit 141 swingably supported on the swing shaft 127, and an exhaust slipper (slipper) 146 furnished to the exhaust arm main unit 141.

The exhaust arm main unit 141 is furnished in a basal section 141*a* thereof with a pair of through-holes 142; has an extending section 143 extending from the basal section 141*a*; and is furnished in a distal end section 141*b* thereof with a mounting hole 144. The swing shaft 127 is pivotably inserted through the pair of through-holes 142, whereby the exhaust arm main unit 141 is swingably supported on the swing shaft 127. Therefore, each of the exhaust arm main unit 141 and the intake arm main unit 131 is swingably supported on the single swing shaft 127. Specifically, the centerline 128 of the swing shaft 127 coincides with the centerline over which the intake rocker arm 121 swings and with the centerline over which the exhaust rocker arm 122 swings.

A valve rod 52*a* of the exhaust valve 52 is mounted in the mounting hole 144 using a nut. The exhaust slipper 146 is provided to a distal end 143*a* of the extending section 143. The exhaust slipper 146 is disposed parallel to the cam face 125 so as to slide against the cam face 125.

The swing shaft 127 is oriented with the centerline 128 of the swing shaft 127 (specifically, the centerline over which the intake rocker arm 121 swings and the centerline over which the exhaust rocker arm 122 swings) inclined by an incline angle θ2 (FIG. 5) with respect to the centerline 124 of the cooling passage 54 (the centerline of rotation of the cam member 47).

According to the aforedescribed valve train 41, the intake slipper 136 is guided by the cam face 125, whereby the intake rocker arm 121 swings centered on the swing shaft 127. The intake valve 51 can be opened and shut as a result of the intake rocker arm 121 swinging around the swing shaft 127.

Similarly, the exhaust slipper 146 is guided by the cam face 125, whereby the exhaust rocker arm 122 swings around the swing shaft 127. The exhaust valve 52 can be opened and shut as a result of the exhaust rocker arm 122 swinging around the swing shaft 127.

Here, as depicted in FIG. 5, the swing shaft 127 is inclined by the incline angle θ2 with respect to the centerline 124 of the cooling passage 54 (the centerline of rotation of the cam member 47). The intake valve 51 is furnished so as to be in an approximately orthogonal orientation with respect to the intake rocker arm 121. Similarly, the exhaust valve 52 is furnished so as to be in an approximately orthogonal orientation with respect to the exhaust rocker arm 122. Therefore, the intake valve 51 and the exhaust valve 52 can be inclined by an incline angle θ3 with respect to a centerline 45 of the cylinder 44.

Figure 7:
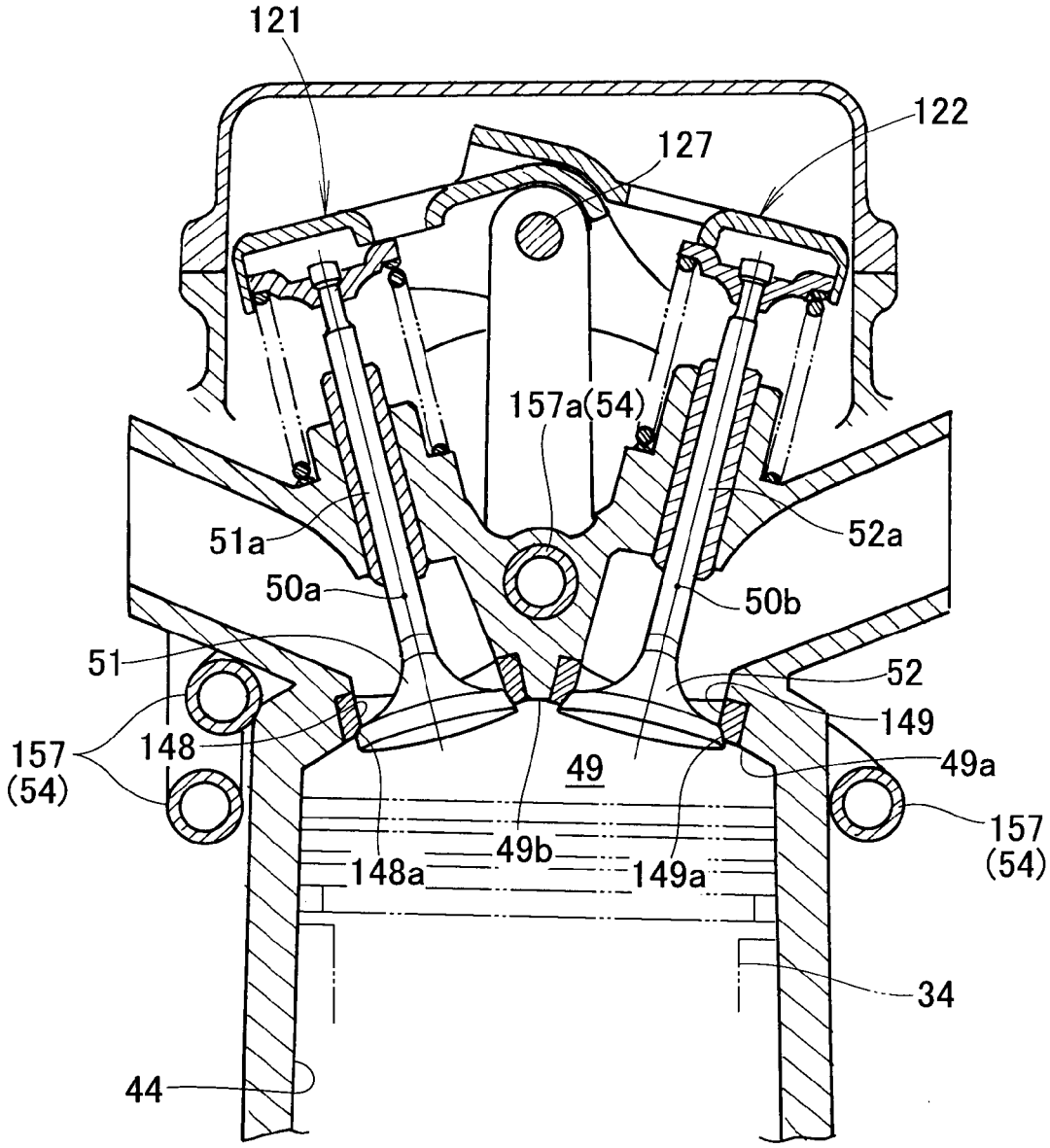
FIG. 7 is a sectional view illustrating an intake valve, an exhaust valve, and a cooling passage of the cooling-means-equipped, liquid-cooled engine according to the present embodiment.

In so doing, as depicted in FIG. 7, the ceiling face (the face opposing the piston inside the cylinder) 49*a* which opposes (faces) the piston inside the cylinder within the combustion chamber 49 can be formed in an approximately semi-spherical shape.

An intake port 148 which is opened and shut by the intake valve 51 and an exhaust port 149 which is opened and shut by the exhaust valve 52 are formed in the ceiling face 49*a*. The intake port 148 is disposed in a direction of a normal 50*a* to the ceiling face 49*a*. The exhaust port 149 is disposed in a direction of a normal 50*b* to the ceiling face 49*a*.

By forming the ceiling face 49*a* in an approximately semi-spherical shape, the shape of the combustion chamber 49 can be given the minimum surface area. By disposing the intake port 148 (the intake valve 51) in the direction of the normal 50*a* with respect to the combustion chamber 49, a seating face 148*a* of the intake valve 51 can be made to conform to the surface of the ceiling face 49*a*. By disposing the exhaust port 149 (the exhaust valve 52) in the direction of the normal 50*b* with respect to the combustion chamber 49, a seating face 149*a* of the exhaust valve 52 can be made to conform to the surface of the ceiling face 49*a*.

It is known that adopting the minimum possible surface area for the shape of the combustion chamber 49, and causing the seating face 148*a* of the intake valve 51 and the seating face 149*a* of the exhaust valve 52 to conform to the surface of the ceiling face 49*a* are factors contributing to efficient combustion of the fuel mixture inside the combustion chamber 49. By adopting the minimum possible surface area for the shape of the combustion chamber 49, and having the seating face 148*a* of the intake valve 51 and the seating face 149*a* of the exhaust valve 52 conform to the surface of the ceiling face 49*a*, the combustion efficiency of the general-purpose liquid-cooled engine 10 can thereby be boosted.

As depicted in FIG. 5, by inclining the intake valve 51 and the exhaust valve 52 with respect to the centerline 45 of the cylinder 44, the intake valve 51 and the exhaust valve 52 can be disposed in an offset fashion from the centerline 45 of the cylinder 44. Therefore, a distal end section 42*a* of the spark plug 42 can be furnished in an apical section 49*b* of the ceiling face 49*a* (FIG. 7). The apical section 49*b* of the ceiling face 49*a* is a region lying on the centerline 45 of the cylinder 44 and in proximity to the centerline 45.

It is known that furnishing the distal end section 42*a* of the spark plug 42 in the apical section 49*b* of the ceiling face 49*a* (FIG. 7) is a factor contributing to efficient combustion of the fuel mixture inside the combustion chamber 49. By furnishing the distal end section 42*a* of the spark plug 42 in the apical section 49*b* of the ceiling face 49*a*, the combustion efficiency of the general-purpose liquid-cooled engine 10 can thereby be boosted.

Next, the cooling means 43 is described on the basis of FIGS. 8 to 11. In FIGS. 8 to 11, as with the description of the valve train 41, the engine body 14 is depicted in an upright state in order in order to facilitate understanding of the configuration of the cooling means 43.

Figure 8:
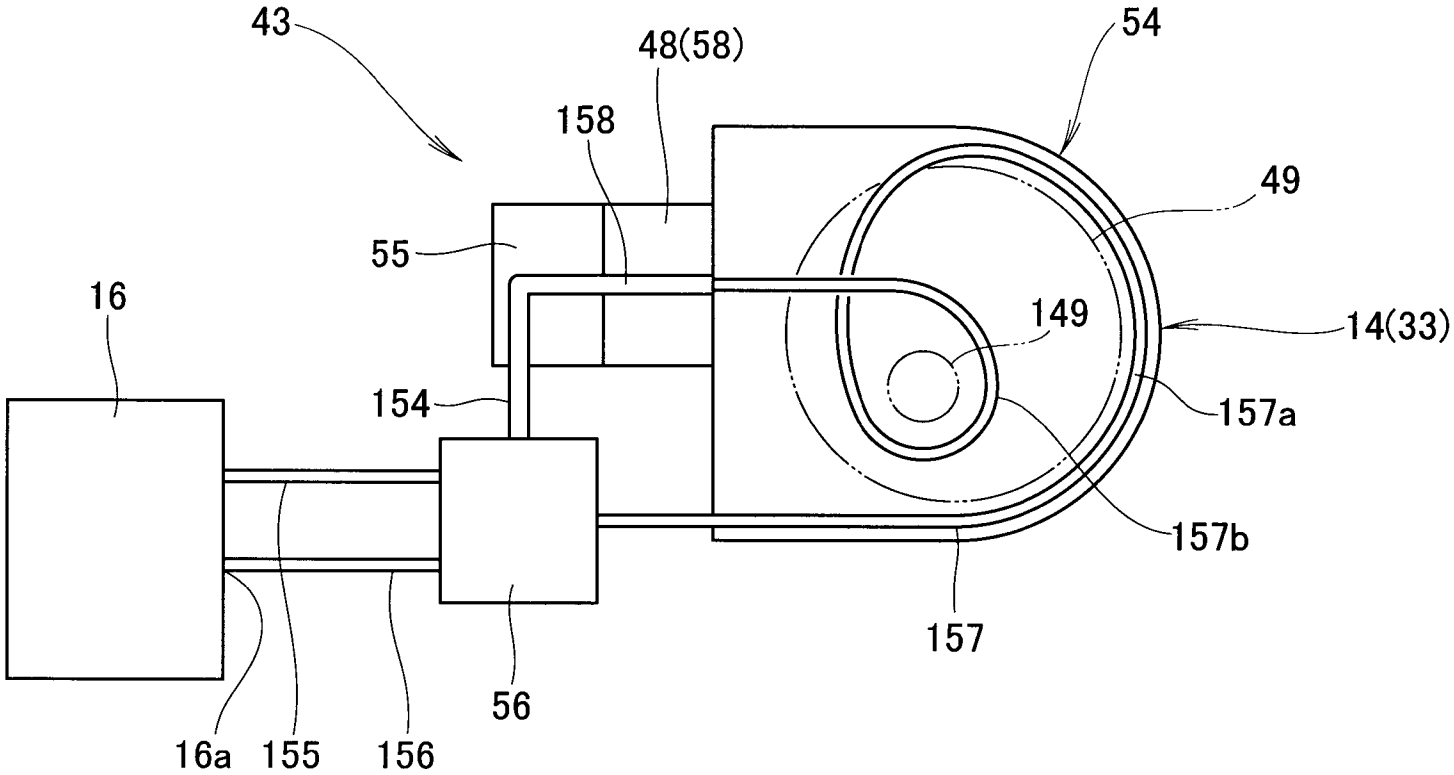
FIG. 8 is a schematic view illustrating the cooling means according to the present embodiment.

As depicted in FIGS. 4 and 8, the cooling means 43 is provided with the cooling passage 54 which circulates the cooling liquid between the cylinder block/head 31 (primarily the cylinder head 33) and the radiator 16; the water pump 55 which is furnished midway along the cooling passage 54; and the thermostat 56 which is furnished to the downstream side of the water pump 55.

The cooling passage 54 is routed in such a way that, after cooling liquid has been introduced from a liquid outlet port 16*a* of the radiator 16 to cool an area surrounding the combustion chamber 49, the introduced cooling liquid returns to the radiator 16 by looping around an area surrounding the exhaust valve 52.

The cooling passage 54 is provided with a first cooling passage section 154 for guiding the cooling liquid from the water pump 55 to the thermostat 56, a second cooling passage section 155 for guiding the cooling liquid from the thermostat 56 to the radiator 16, a third cooling passage section 156 for guiding the cooling liquid from the radiator 16 to the thermostat 56, a fourth cooling passage section 157 for guiding the cooling liquid from the thermostat 56 to the cylinder head 33, and a fifth cooling passage section (hollow cam shaft) 158 for guiding the cooling liquid from the fourth cooling passage section 157 to the water pump 55.

Examples of the material for the cooling passage 54 include pipe material (STKM12A), SUS304 material, or aluminum material (A6061 material).

Figure 9:
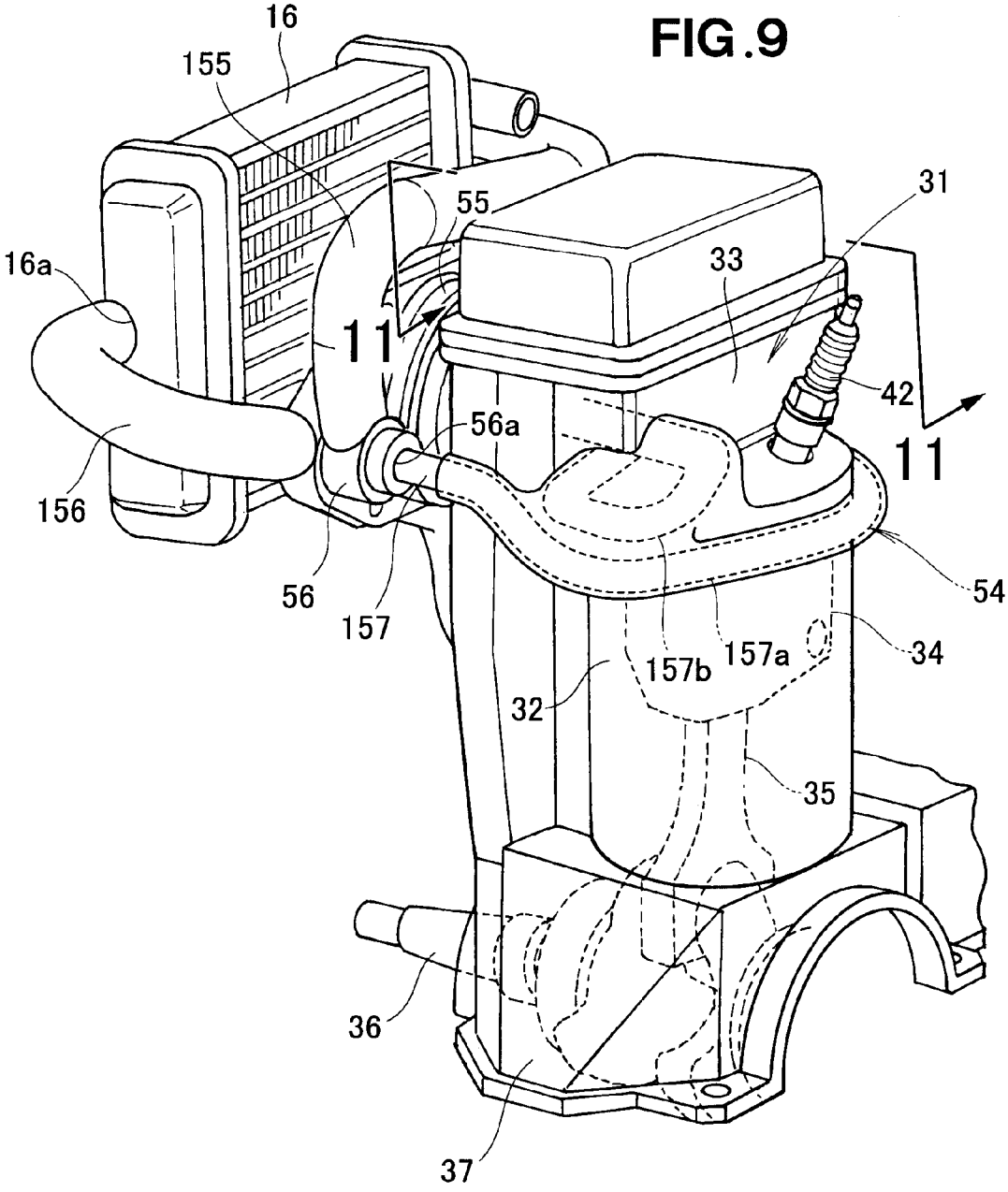
FIG. 9 is a perspective view showing the cooling means according to the present embodiment.
Figure 10:
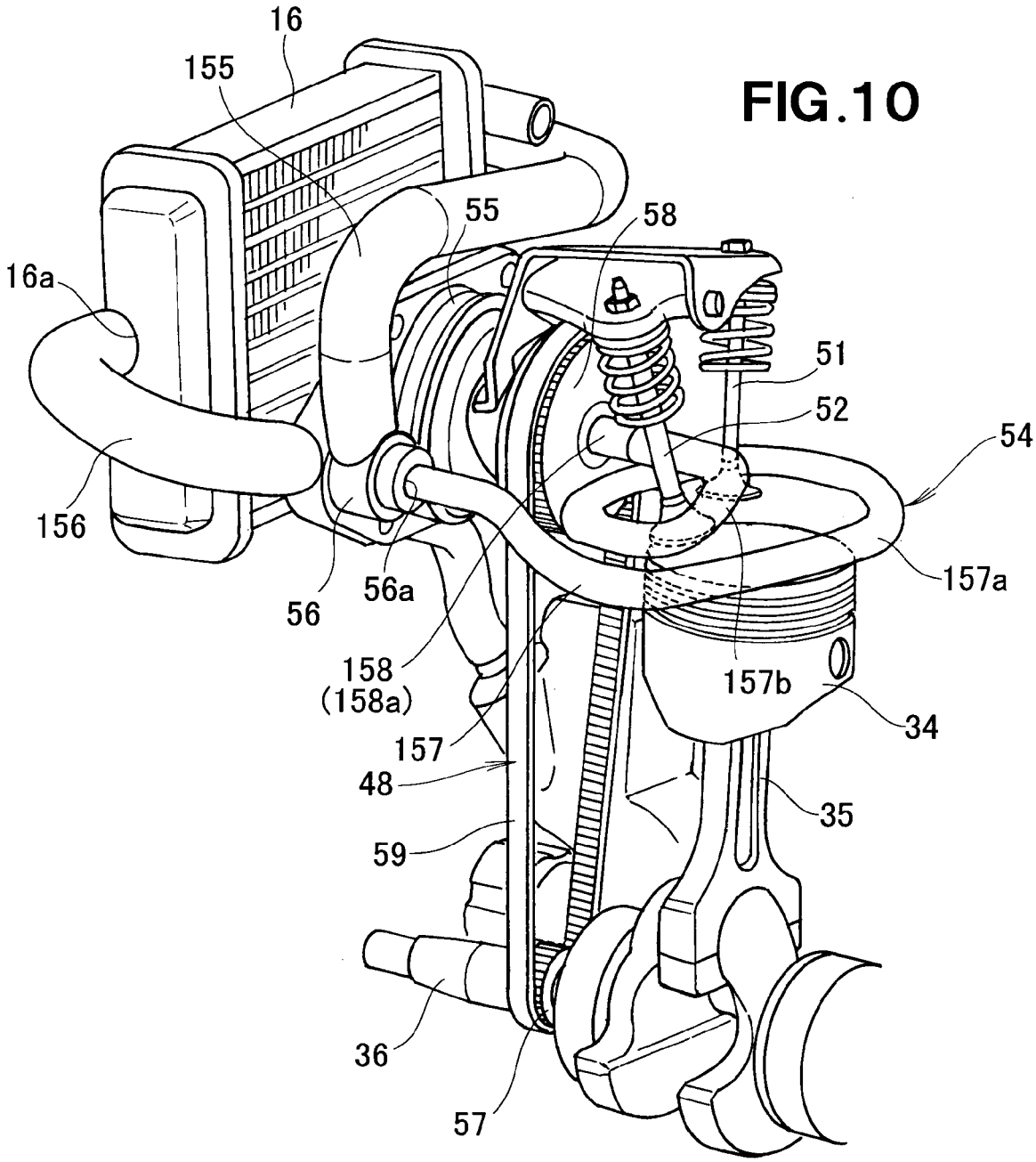
FIG. 10 is a perspective view showing the cooling means of FIG. 9, with the cylinder block/head removed.

As depicted in FIGS. 9 and 10, the fourth cooling passage section 157 is formed in a continuous fashion so as to constitute a single unbranching passage (so as to produce a single stroke), so that after the cooling liquid has been introduced from a liquid outlet port 56*a* of the thermostat 56 to cool an area surrounding the combustion chamber 49 (FIG. 8), the introduced cooling liquid returns to the water pump 55 after looping around an area surrounding the exhaust valve 52. Specifically, the fourth cooling passage section 157 has a combustion chamber cooling passage section 157*a* which is embedded along the outside periphery of the combustion chamber 49 (FIG. 8), and an exhaust port cooling passage section 157*b* which is embedded along an area surrounding the exhaust valve 52.

The combustion chamber cooling passage section 157*a* is furnished along the outside periphery of the combustion chamber 49 (FIG. 8) by being embedded (inset) inside the cylinder block/head 31 of the integrally molded cylinder block 32 and cylinder head 33. "Embedding" of the combustion chamber cooling passage section 157*a* is used in a sense that includes a state in which the entire combustion chamber cooling passage section 157*a* is embedded, and a state in which a portion of the combustion chamber cooling passage section 157*a* is embedded.

The exhaust port cooling passage section 157*b* is furnished along the outside periphery of the exhaust valve 52 (the exhaust port 149 (FIG. 8)) by being embedded (inset) inside the cylinder head 33. As mentioned previously, the exhaust valve 52 is a valve for opening and shutting the exhaust port 149 of the combustion chamber 49 (FIG. 8). As with the combustion chamber cooling passage section 157*a*, "embedding" of the exhaust port cooling passage section 157*b* is used in a sense that includes a state in which the entire exhaust port cooling passage section 157*b* is embedded, and a state in which a portion of the exhaust port cooling passage section 157*b* is embedded.

"Insetting" refers to embedding the combustion chamber cooling passage section 157*a* and the exhaust port cooling passage section 157*b* inside the cylinder block/head 31, and in this state, welding them to the cylinder block/head 31.

By causing the cooling liquid to flow into the fourth cooling passage section 157, the cooling liquid can thus be made to flow along an area surrounding the combustion chamber 49, and the cooling liquid having cooled the area surrounding the combustion chamber 49 can be caused to flow while looping around an area surrounding the exhaust port 149. In so doing, the area surrounding the combustion chamber 49 can be cooled by the cooling liquid, and the area surrounding the exhaust port 149 can be cooled by the cooling liquid.

In the liquid-cooled engine 10 equipped with cooling means, the area surrounding the combustion chamber 49 and the area surrounding the exhaust valve 52 (the exhaust port 149) are ordinarily at higher temperatures than other regions. Therefore, ample cooling capacity can be ensured by cooling the area surrounding the combustion chamber 49 and the area surrounding the exhaust port 149 using the cooling liquid.

Figure 11:
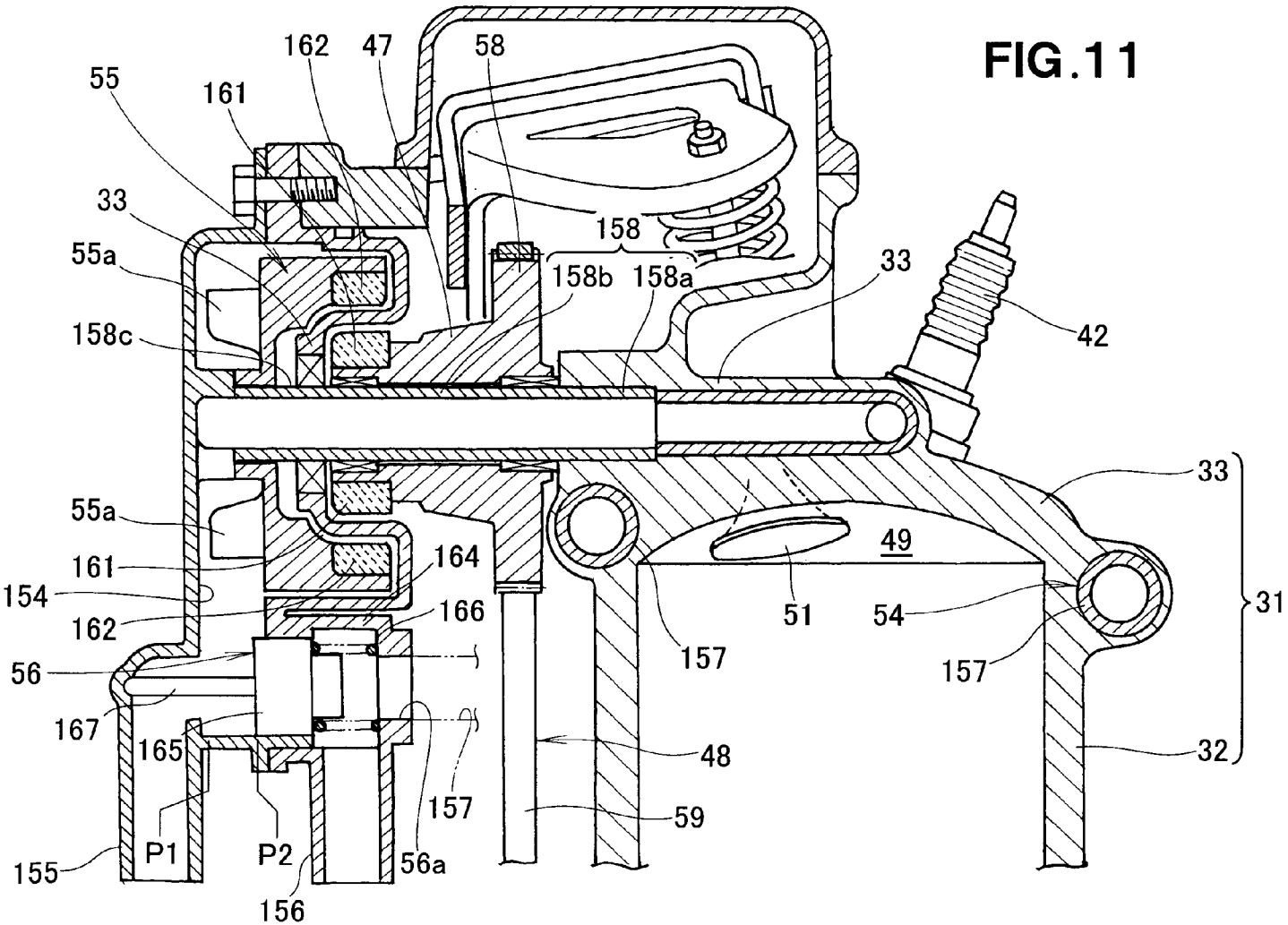
FIG. 11 is a sectional view taken along line 11-11 of FIG. 9.

As depicted in FIGS. 7 and 11, the fourth cooling passage section 157 is embedded inside the cylinder block/head 31 by virtue of being inset in the cylinder block/head 31 of the integrally formed cylinder block 32 and cylinder head 33.

By embedding the fourth cooling passage section 157 inside the cylinder block/head 31, compactness of the liquid-cooled engine 10 equipped with cooling means can thus be maintained. In so doing, ample cooling capacity can be ensured while maintaining compactness of the liquid-cooled engine 10 equipped with cooling means.

Additionally, the cylinder block 32 and the cylinder head 33 are integrally formed. Through integral formation of the cylinder block 32 and the cylinder head 33, it is possible to maintain compactness of the liquid-cooled engine 10 equipped with cooling means.

The fourth cooling passage section 157 of continuous form can be embedded in this state during integral formation of the cylinder block 32 and the cylinder head 33. In so doing, the cooling passage can be easily embedded inside the integrally formed cylinder block 32 and cylinder head 33 (specifically, the cylinder block/head 31).

As depicted in FIG. 11, the fifth cooling passage section 158 is a pipe of tubular shape, a basal section 158*a* being embedded inside the cylinder head 33, most of a region 158*b* protruding from the cylinder head 33, and the proximity to a distal end section 158*c* being supported by the cylinder head 33. Specifically, the basal section 158*a* and the proximity to the distal end section 158*c* of the fifth cooling passage section 158 are supported by the cylinder head 33. The cam member 47 and the driven pulley 58 are rotatably supported by substantially the entire region 158*b* protruding from the cylinder head 33.

The fifth cooling passage section 158 jointly serves as a cam shaft for rotatably supporting the cam member 47 and the driven pulley 58. In other words, the fifth cooling passage section 158 is a hollow member that supports the cam member 47 and the driven pulley 58, as well as serving as a portion of the cooling passage 54. Therefore, the need for a dedicated cam shaft, which according the prior art is necessary to support the cam member 47, can be obviated. In so doing, the number of parts can be reduced, the need for space to furnish the dedicated cam shaft can be obviated, and the liquid-cooled engine 10 equipped with cooling means can be made even more compact.

The outside peripheral section of the distal end of the cam member 47 is furnished with a plurality of driving-side magnets 161 at equal spacing in the circumferential direction. The plurality of driving-side magnets 161 is furnished in a region facing (opposing) a plurality of driven-side magnets 162 provided to the water pump 55.

The water pump 55 is rotatably supported at the distal end section 158*c* of the fifth cooling passage section 158. Specifically, the fifth cooling passage section 158 serves as a cam shaft for rotatably supporting the cam member 47 and the driven pulley 58, and serves as a support shaft for the water pump 55. Therefore, the water pump 55 is furnished on the same axis as the cam member 47 and the driven pulley 58. In other words, the water pump 55 is furnished on the same axis as the cam shaft (the fifth cooling passage section 158). Therefore, the need for a dedicated pump shaft, which according the prior art is necessary to support the water pump 55, can be obviated. In so doing, the number of parts can be reduced, the need for space to furnish the dedicated pump shaft can be obviated, and the liquid-cooled engine 10 equipped with cooling means can be made even more compact.

In the water pump 55, the plurality of driven-side magnets 162 is furnished at equal spacing in the circumferential direction so as to face (oppose) the plurality of driving-side magnets 161. Therefore, the plurality of driving-side magnets 161 rotates by rotation of the cam member 47 and the driven pulley 58. Through rotation of the plurality of driving-side magnets 161, the plurality of driven-side magnets 162 rotates in accordance with the plurality of driving-side magnets 161. The water pump 55 rotates through rotation of the plurality of driven-side magnets 162.

Through rotation of the water pump 55, a fin (impeller) 55*a* of the water pump 55 rotates. Through rotation of the guide fin 55*a* of the water pump 55, the cooling liquid which has been guided from the fifth cooling passage section 158 to the water pump 55 is supplied to the first cooling passage section 154 (FIG. 8) by the guide fin 55*a*. The cooling liquid supplied to the first cooling passage section 154 is guided to the thermostat 56 through the first cooling passage section 154.

The thermostat 56 is a thermostat of ordinary design having a valve 165 housed inside a body 164 and a needle 167 protruding from the valve 165, with the valve 165 pressed by a spring 166.

In a case where the cooling liquid has not risen to a prescribed temperature, in the aforedescribed thermostat 56, the needle 167 is housed inside the valve 165, and the valve 165 is disposed at a position P1 by the urging force of the spring 166. Therefore, the cooling liquid that has cooled the engine body 14 can be guided into the fourth cooling passage section 157.

On the other hand, in a case where the cooling liquid has risen to the prescribed temperature, in the thermostat 56, the needle 167 protrudes from inside of the valve 165, and the valve 165 is disposed at a position P2 in opposition to the urging force of the spring 166. Therefore, the cooling liquid that has cooled the engine body 14 can be guided into the second cooling passage section 155, and the cooling liquid of the third cooling passage section 156 can be guided into the fourth cooling passage section 157.

Figure 12A:
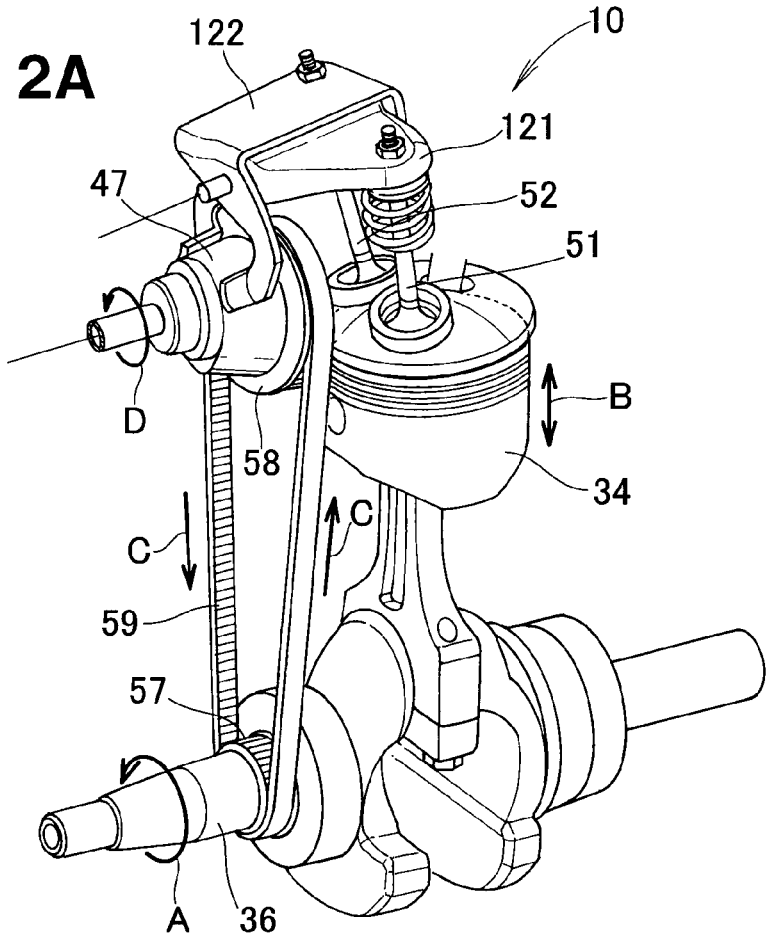
FIG. 12A and FIG. 12B are views illustrating an example operation of the intake valve and the exhaust valve of the valve train provided to the liquid-cooled engine equipped with the cooling means according to the present embodiment.
Figure 12B:
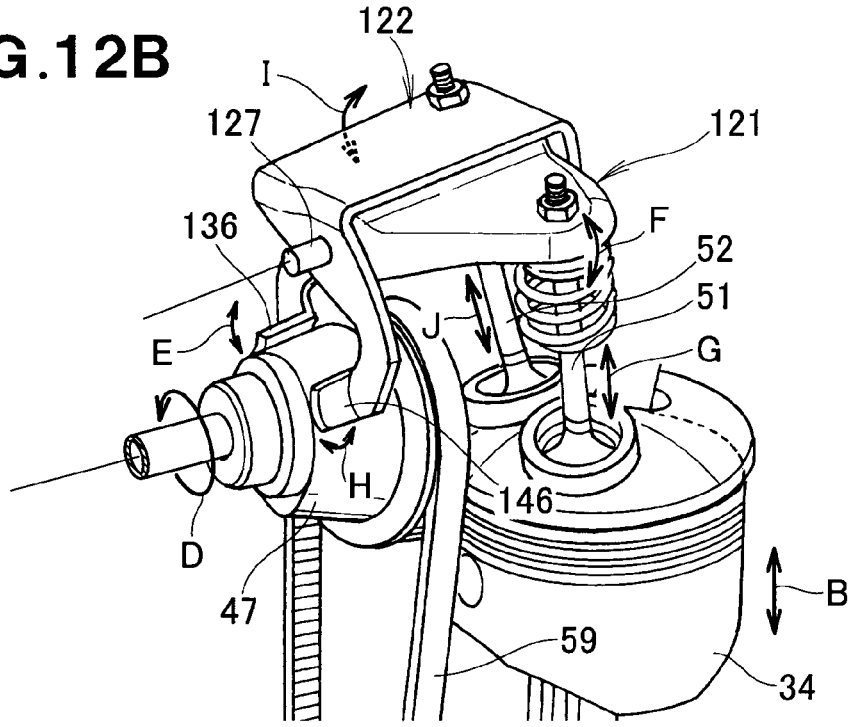

Next, an example of operation of the intake valve 51 and the exhaust valve 52 of the valve train 41 is described on the basis of FIG. 12A and FIG. 12B.

As depicted in FIG. 12A, by rotation of the crankshaft 36 as shown by arrow A the piston 34 moves in the direction of arrow B. At the same time, by rotation of the crankshaft 36 as shown by arrow A, the transmission belt 59 rotates as shown by arrow C on the driving pulley 57. By rotation of the transmission belt 59 the driven pulley 58 rotates as shown by arrow D. By rotation of the driven pulley 58, the cam member 47 rotates as shown by arrow D.

As depicted in FIG. 12B, by rotation of the cam member 47, the intake slipper 136 rocks as shown by arrow E. Rocking of the intake slipper 136 as shown by arrow E causes the intake rocker arm 121 to swingably rock about the swing shaft 127 as shown by arrow F. Swinging of the intake rocker arm 121 causes the intake valve 51 to move up and down as shown by arrow G.

At the same time, by rotation of the cam member 47, the exhaust slipper 146 rocks as shown by arrow H. Rocking of the exhaust slipper 146 as shown by arrow H causes the exhaust rocker arm 122 to rock about the swing shaft 127 as shown by arrow I. Swinging of the exhaust rocker arm 122 causes the exhaust valve 52 to move up and down as shown by arrow J.

Figure 13:
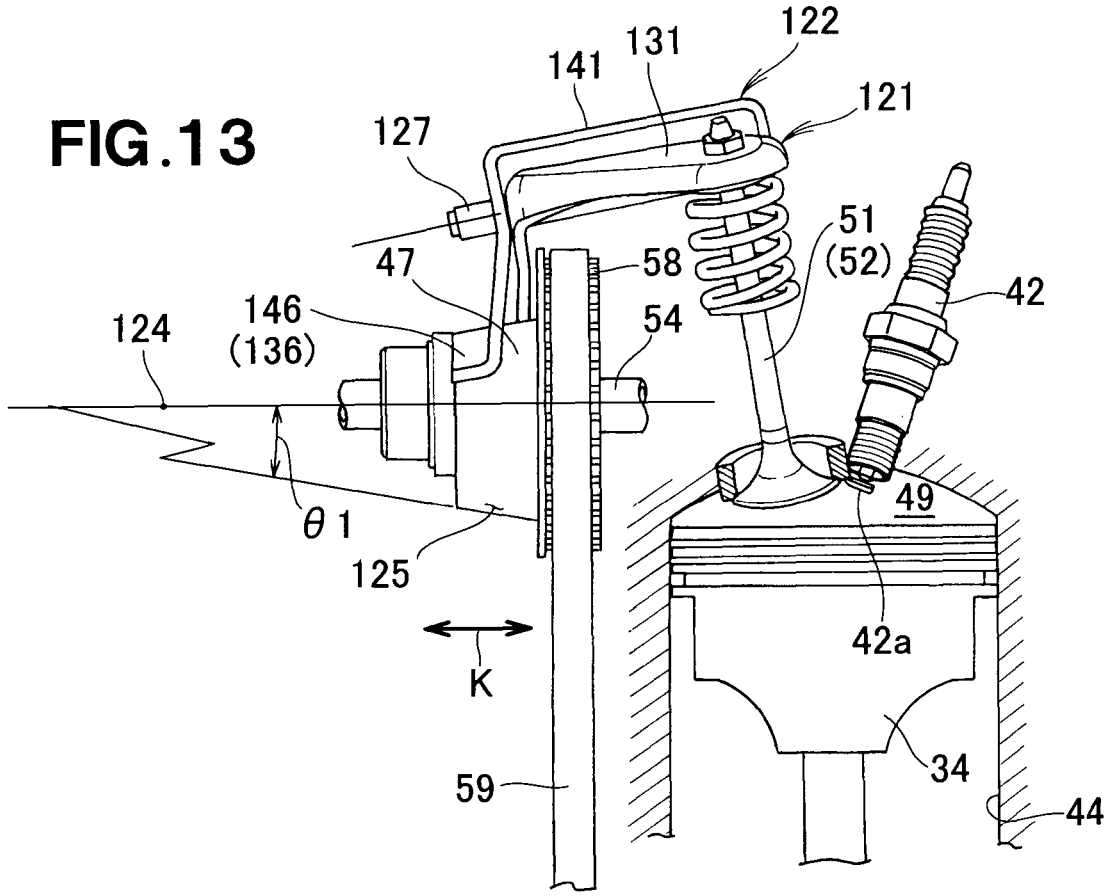
FIG. 13 is a view illustrating an example of adjustment to increase or decrease the amount of valve lift of the intake valve and the exhaust valve of FIG. 12A.

Next, an example in which the cam member 47 of the liquid-cooled engine 10 equipped with cooling means is moved along the cooling passage 54 in order to make an adjustment increasing or decreasing the amount of valve lift of the intake valve 51 and the exhaust valve 52 is described on the basis of FIG. 13.

As depicted in FIG. 13, the cam face 125 of the cam member 47 is inclined at an incline angle θ1 with respect to the centerline (the centerline of rotation of the cam member 47) 124 of the cooling passage 54. The intake slipper 136 and the exhaust slipper 146 slide against the inclined cam face 125. Therefore, by moving the cam member 47 along the cooling passage 54 as shown by arrow K, adjustments can be made to increase or decrease the amount of valve lift of the intake valve 51 and the exhaust valve 52. Further, by moving the cam member 47 along the cooling passage 54 as shown by arrow K, the function of a lash adjusting mechanism can be performed.

Next, examples of cooling of the engine body 14 by the cooling means 43 are described on the basis of FIGS. 14A, 14B, 15A, and 15B.

Figure 14A:
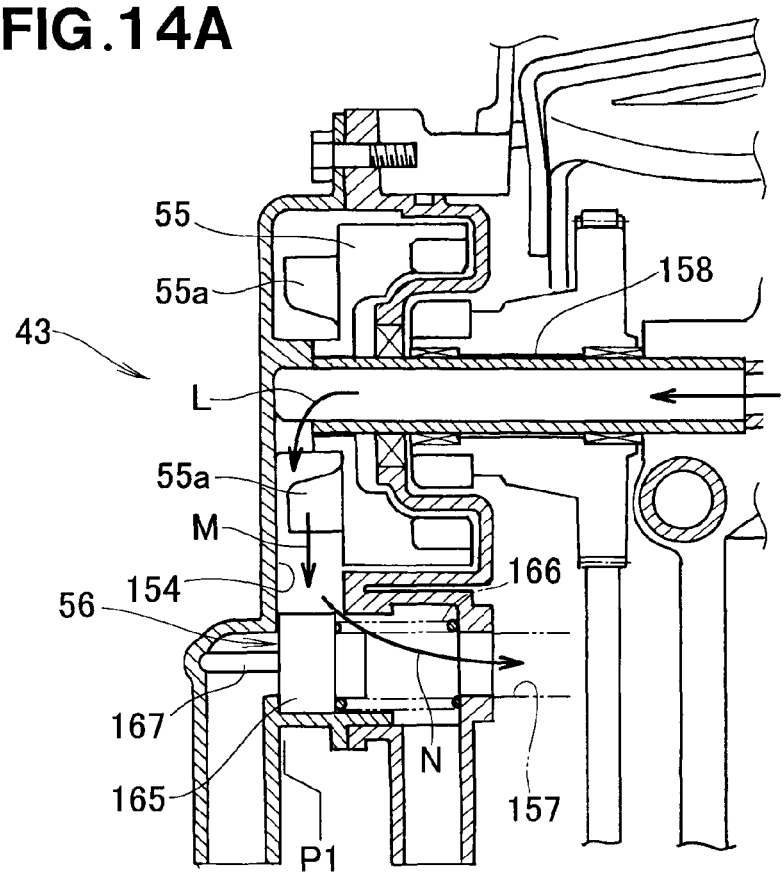
FIG. 14A and FIG. 14B are views illustrating an example of cooling of the engine body in a state in which the cooling liquid has not risen to a prescribed temperature in the cooling means according to the present embodiment.
Figure 14B:
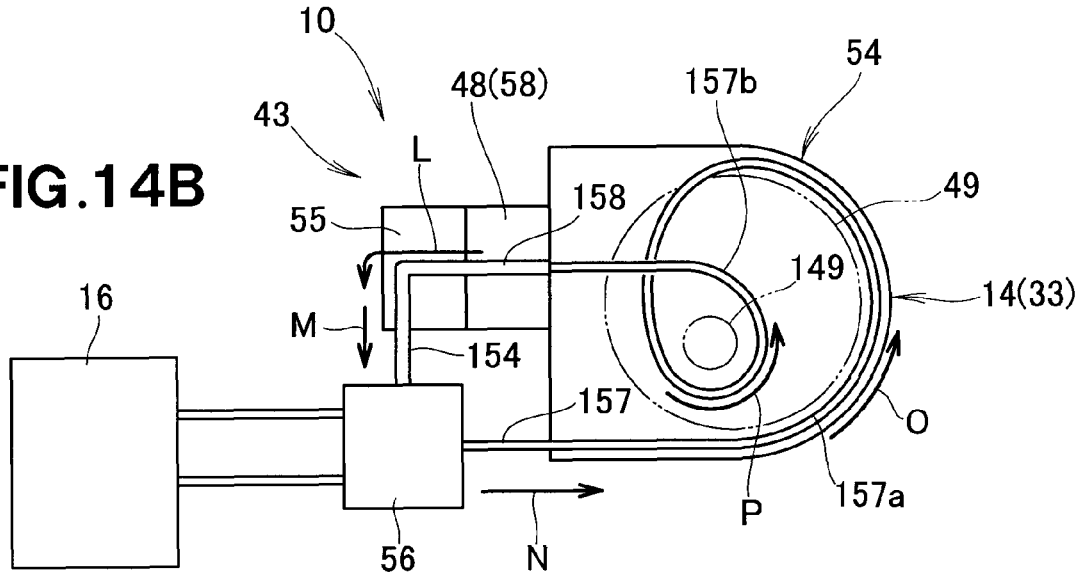

First, an example of cooling of the engine body 14 by the cooling means 43 in a state in which the cooling liquid has not risen to a prescribed temperature is described on the basis of FIGS. 14A and 14B.

As depicted in FIG. 14A, the cooling liquid is guided from the fifth cooling passage section 158 to the water pump 55 as shown by an arrow L. In a case where the cooling liquid has not risen to the prescribed temperature, the needle 167 is housed inside the valve 165, and the valve 165 is disposed at a position depicted by P1 under the urging force of the spring 166.

In this state, the cooling liquid is supplied from the water pump 55 to the thermostat 56 through the first cooling passage section 154 as shown by arrow M. The cooling liquid supplied to the thermostat 56 is guided into the fourth cooling passage section 157 as shown by arrow N.

By guiding the cooling liquid into the fourth cooling passage section 157 as depicted in FIG. 14B, the cooling liquid is guided to the combustion chamber cooling passage section 157*a* as shown by arrow O. By causing the cooling liquid to flow to the combustion chamber cooling passage section 157*a*, the cooling liquid can be caused to flow along the area surrounding the combustion chamber 49. Therefore, the area surrounding the combustion chamber 49 can be cooled by the cooling liquid.

In the liquid-cooled engine 10 equipped with cooling means, the area surrounding the exhaust valve 52 (the exhaust port 149) depicted in FIG. 10 is ordinarily at a higher temperature than other regions. Therefore, the cooling liquid caused to flow through the combustion chamber cooling passage section 157*a* is guided to the exhaust port cooling passage section 157*b* as shown by arrow P. By causing the cooling liquid to flow to the exhaust port cooling passage section 157*b*, the cooling liquid can be caused to flow along the area surrounding the exhaust port 149. Therefore, the area surrounding the exhaust port 149 can be cooled by the cooling liquid.

By cooling the area surrounding the combustion chamber 49 using the cooling liquid and cooling the area surrounding the exhaust port 149 using the cooling liquid, the engine body 14 can thus be favorably cooled.

Figure 15A:
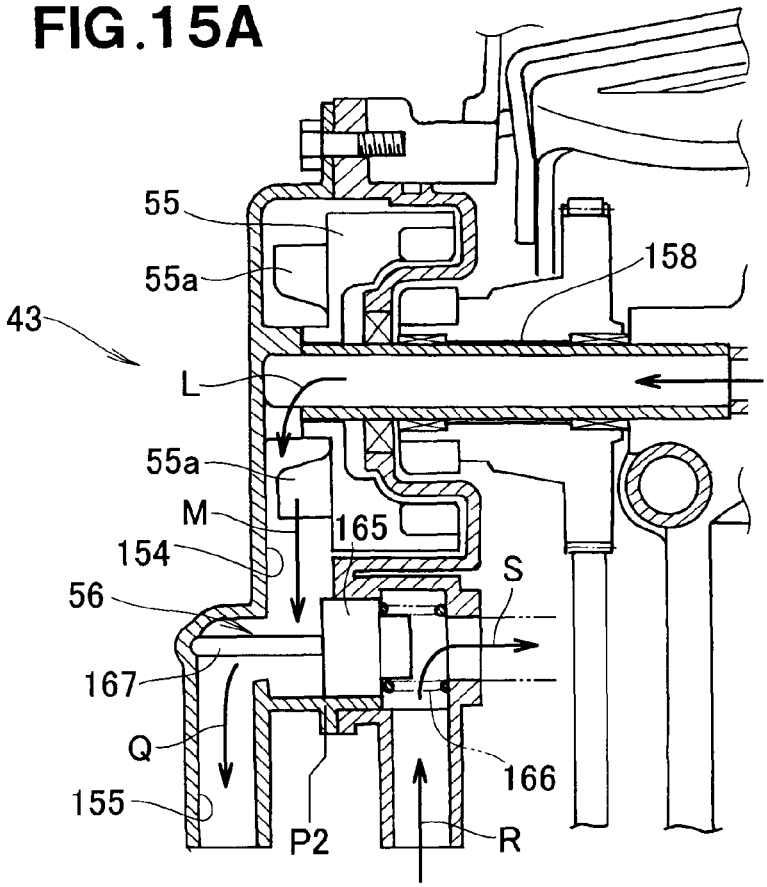
FIG. 15A and FIG. 15B are views illustrating an example of cooling of the engine body in a state in which the cooling liquid has risen to the prescribed temperature in the cooling means according to the present embodiment.
Figure 15B:
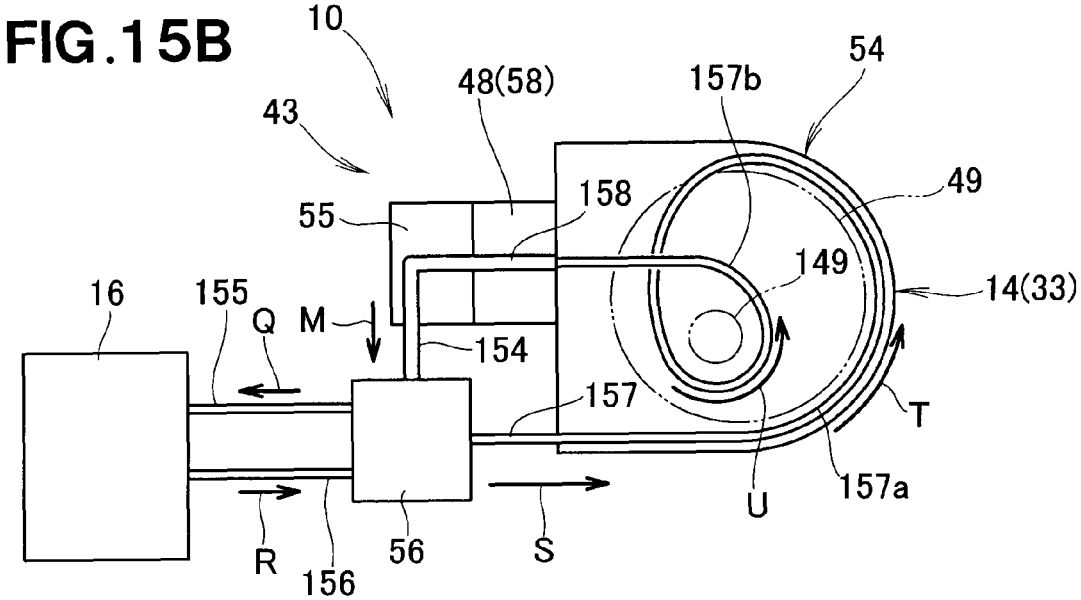

Next, an example of cooling of the engine body 14 by the cooling means 43 in a state in which the cooling liquid has risen to the prescribed temperature is described on the basis of FIGS. 15A, 15B.

As depicted in FIG. 15A, the cooling liquid is guided from the fifth cooling passage section 158 to the water pump 55 as shown by arrow L. In a case where the cooling liquid has risen to the prescribed temperature, the needle 167 protrudes from the valve 165. Therefore, the valve 165 of the thermostat 56 is disposed at a position P2 in opposition to the urging force of the spring 166.

In this state, the cooling liquid is supplied from the water pump 55 to the thermostat 56 through the first cooling passage section 154 as shown by the arrow M. The cooling liquid supplied to the thermostat 56 is guided into the second cooling passage section 155 as shown by arrow Q.

By guiding the cooling liquid into the second cooling passage section 155 as depicted in FIG. 15B, the cooling liquid is guided to the radiator 16 as shown by arrow Q. The cooling liquid that has flowed to the radiator 16 is cooled by the radiator 16. The cooling liquid cooled by the radiator 16 is guided to the thermostat 56 through the third cooling passage section 156 as shown by arrow R. The cooling liquid guided to the thermostat 56 is guided to the fourth cooling passage section 157 through the thermostat 56 as shown by an arrow S.

By guiding the cooling liquid into the fourth cooling passage section 157, the cooling liquid is guided to the combustion chamber cooling passage section 157*a* as shown by arrow T. By causing the cooling liquid to flow to the combustion chamber cooling passage section 157*a*, the cooling liquid can be made to flow along the area surrounding the combustion chamber 49. Therefore, the area surrounding the combustion chamber 49 can be cooled using the cooling liquid.

In the liquid-cooled engine 10 equipped with cooling means, the area surrounding the exhaust valve 52 (the exhaust port 149) is ordinarily at a higher temperature than other regions. Therefore, the cooling liquid caused to flow through the combustion chamber cooling passage section 157*a* is guided to the exhaust port cooling passage section 157*b* as shown by arrow U. By having the cooling liquid flow to the exhaust port cooling passage section 157*b*, the cooling liquid can be made to flow along the area surrounding the exhaust port 149. Therefore, the area surrounding the exhaust port 149 can be cooled by the cooling liquid.

By cooling the area surrounding the combustion chamber 49 using the cooling liquid and cooling the area surrounding the exhaust port 149 using the cooling liquid, the engine body 14 can thus be favorably cooled.

The liquid-cooled engine equipped with cooling means according to the present invention is not limited to the embodiment set forth above; modifications and improvements thereto may be made as appropriate. For example, whereas the embodiment described an example of embedding the cooling passage 54 (the fourth cooling passage section 157) inside the cylinder block/head 31 (the cylinder block 32 and the cylinder head 33), such an arrangement is not provided by way of limitation; the fourth cooling passage section 157 may be embedded inside the cylinder head 33 exclusively.

Further, whereas the embodiment depicted an example of a water-cooled general-purpose engine as a general-purpose engine of a liquid-cooled type, it is possible for other liquids to be used as a cooling liquid.

The shapes and configurations of the liquid-cooled engine 10 equipped with cooling means, the radiator 16, the cylinder block/head 31, the cylinder block 32, the cylinder head 33, the cam member 47, the combustion chamber 49, the intake valve 51, the exhaust valve 52, the cooling passage 54, the water pump 55, the exhaust port 149, the fifth cooling passage section (cam shaft) 158, and the like are not limited to the exemplary ones depicted in the embodiment; and may be modified as appropriate.

The present invention is suitable for implementation in liquid-cooled engines equipped with cooling means for cooling an area surrounding a combustion chamber with a cooling liquid cooled by a radiator and caused to flow through a cooling passage.

What is claimed is:

1. A cooling-means-equipped, liquid-cooled engine comprising:

an engine body including a cylinder block, a cylinder head, a piston movably disposed in the cylinder block to undergo reciprocating movement, a combustion chamber defined between the cylinder block, the cylinder head and the piston, an exhaust port formed in the cylinder head in communication with the combustion chamber, and an exhaust valve for opening and closing the exhaust port;

a radiator; and a cooling passage connected to the radiator and configured to guide a cooling liquid cooled in the radiator to flow therethrough to thereby cool an area surrounding the combustion chamber of the engine body and an area surrounding the exhaust valve, wherein the cooling passage comprises a single pipe embedded in the cylinder head and formed in a continuous fashion to constitute a single unbranching passage, the pipe having a combustion chamber cooling passage section embedded along an outer periphery of the combustion chamber, and an exhaust port cooling passage section continuous with the combustion chamber cooling passage section and embedded along the area surrounding the exhaust valve.

2. The engine of claim 1, wherein the cylinder block and the cylinder head are integrally formed.

3. The engine of claim 1, further comprising: a pump driven by the engine for circulating the cooling liquid through the cooling passage; a cam for driving an intake valve and the exhaust valve for opening and closing the combustion chamber; and a hollow cam shaft pivotally supporting the cam and serving as a portion of the cooling passage, the hollow cam shaft rotatably supporting thereon the pump.

* * * * *